US007731142B2

(12) United States Patent
Chen et al.

(10) Patent No.: US 7,731,142 B2
(45) Date of Patent: Jun. 8, 2010

(54) TOOL-LESS MOUNTING SLIDE BRACKET

(75) Inventors: Ken-Ching Chen, Kaohsiung Hsien (TW); Shun-Ho Yang, Kaohsiung Hsien (TW); Chun-Chiang Wang, Kaohsiung Hsien (TW)

(73) Assignee: King Slide Works Co., Ltd., Kaohsiung-Hsien (TW)

( * ) Notice: Subject to any disclaimer, the term of this patent is extended or adjusted under 35 U.S.C. 154(b) by 178 days.

(21) Appl. No.: 12/003,521

(22) Filed: Dec. 28, 2007

(65) Prior Publication Data

US 2009/0167127 A1 Jul. 2, 2009

(51) Int. Cl.
*A47G 29/02* (2006.01)

(52) U.S. Cl. ..... 248/244

(58) Field of Classification Search ..... 248/244
See application file for complete search history.

(56) References Cited

U.S. PATENT DOCUMENTS 6,422,399 B1 7/2002 Castillo et al.
6,442,030 B1 8/2002 Mammoser et al.
6,554,142 B2 4/2003 Gray
6,659,577 B2 12/2003 Lauchner
6,702,124 B2 3/2004 Lauchner et al.
6,726,164 B1 4/2004 Baiza et al.
6,749,275 B2 6/2004 Cutler et al.
6,773,080 B2 8/2004 Chen et al.
6,856,505 B1 2/2005 Venegas et al.
6,866,154 B2 3/2005 Hartman et al.
6,871,920 B2 3/2005 Greenwald et al.
6,929,339 B1 8/2005 Greenwald et al.
6,935,711 B1 8/2005 Naue et al.
6,948,691 B2 9/2005 Brock et al.
6,957,878 B2 10/2005 Greenwald et al.
7,093,725 B2 8/2006 Hartman et al.
7,137,512 B2 11/2006 Nguyen et al.
7,144,184 B1 12/2006 Tsai
7,192,103 B2 3/2007 Hamilton
7,281,633 B2 10/2007 Hartman et al.
7,281,694 B2 10/2007 Allen et al.
7,284,672 B2 10/2007 Tsai
2005/0156493 A1* 7/2005 Yang et al. ..... 312/334.5
2005/0196230 A1 9/2005 Dubon et al.
2008/0067907 A1* 3/2008 Chen et al. ..... 312/312
2008/0073469 A1* 3/2008 Mushan et al. ..... 248/205.1
2009/0166485 A1* 7/2009 Chen et al. ..... 248/200

* cited by examiner

*Primary Examiner*—J. Allen Shriver, II
*Assistant Examiner*—Erin Smith
(74) *Attorney, Agent, or Firm*—Rosenberg, Klein & Lee

(57) ABSTRACT

A slide bracket free of tool mounting includes a body, a base, first hangers, first resilient elements, second hangers, a hook and a second resilient element. The body comprises a fixing board. The first hanger, the first resilient element and the second hanger are located between the fixing board and the base. The fixing board is provided with a first longitudinal trough while the base is provided with a second longitudinal trough and a chute. The second longitudinal trough corresponds to the first longitudinal trough of the fixing board. The hook, having an angle and a stopper, penetrates the first longitudinal trough, the chute and the second longitudinal trough. The stopper slips relatively to the chute. The second resilient element upholds to the knob, which moves the hook relatively to the rack, and makes the angle buckled in a rack.

7 Claims, 6 Drawing Sheets

TOOL-LESS MOUNTING SLIDE BRACKET

BACKGROUND OF THE INVENTION

1. Field of the Invention

The present invention relates to a slide bracket which is free of tool mounting, and more particularly to a slide bracket capable of prompt mounting and demounting, which also conforms to the mounting holes of various specifications.

2. Description of the Prior Art

A handy mounting of a bracket integrated with a slide into the metal rack is frequently viewed in the rack-mounted computer system.

This category of the slide brackets are quite copious in their designs; however, the leading trends recently come in tool-less and in prompt mounting and demounting, and are available for the racks of different mounting requirements. For instance, the mounting holes of a variety of specifications, as USPTO issued patents of U.S. Pat. Nos. 6,659,577 B2; 6,702,124 B2; 7,281,694 B2; 7,144,184 B2 (Taiwan Patent No.: M281525); U.S. Pat. No. 7,284,672 B2 (Taiwan Patent No.: M281520), and a published application of 20050156493 A1.

The foregoing disclosed prior art are devising the hangers of the bracket into segmented poles of different diameters, for the support of the mounting holes of various specifications, and are exploiting the elastomers of the bracket or the movable and interval-adjustable fasteners to attach firmly the bracket in the rack; however, once this kind of the bracket is mounted, the dismount of it can only be done from its side, which means it would possibly be hard to have a single slide and bracket of a server demounted from arrays of slides and brackets of servers. The USPTO published application of 20050156493 is the prior art of the present invention and is invented by the same inventor.

SUMMARY OF THE INVENTION

It is accordingly an object of this invention to provide a slide bracket free of tool mounting, which can be disposable of having a single slide and a bracket demounted from arrays of slides and brackets, and capable of conforming to the mounting holes of different specifications.

According to the present invention, there is provided a tool-less mounting slide bracket, comprising:

- a body, comprising a fixing board, provided with openings and a first longitudinal trough thereon;
- a base, comprising lodging spaces, a second longitudinal trough and a chute, wherein the lodging space corresponds to the opening of the fixing board, and the second longitudinal trough corresponds to the first longitudinal trough of the fixing board;
- first hangers, each connecting to the lodging space of the base;
- first resilient elements, each wearing on the first hanger;
- second hangers, each wearing on the first hanger, clamping said first resilient element and being movable in the opening and the lodging space;
- a hook, comprising an angle and a stopper, penetrating the first longitudinal trough, the chute and the second longitudinal trough, and the stopper slipping in the chute; and
- a second resilient element, corresponding to the hook and clamping the hook to drive the angle to move horizontally.

Preferably, the tool-less mounting slide bracket further comprises a knob, said hook further comprising a connecting section fixed to the knob.

Preferably, the knob is connected to the second resilient element and the second resilient element is a resilient bar.

Preferably, the base is provided with a flute.

Alternatively, the knob and the second resilient element are disposed in the flute of the base, the second resilient element is positioned against the knob, and the second resilient element is a spring.

Alternatively, the first hanger and the second hanger are formed in the base into an all-in-one shape which is a bi-segment cylinder.

Preferably, the angle of the hook comprises a first bend and a second bend.

Accordingly, the improved feature and advantage are as follows:

a. apply to the racks with mounting holes in different specifications.

b. handy to engage in a dismount right in the bracket front, available for having a single slide and a bracket demounted from arrays of slides and brackets.

DETAILED DESCRIPTION OF THE PREFERRED EMBODIMENT

Figure 1:
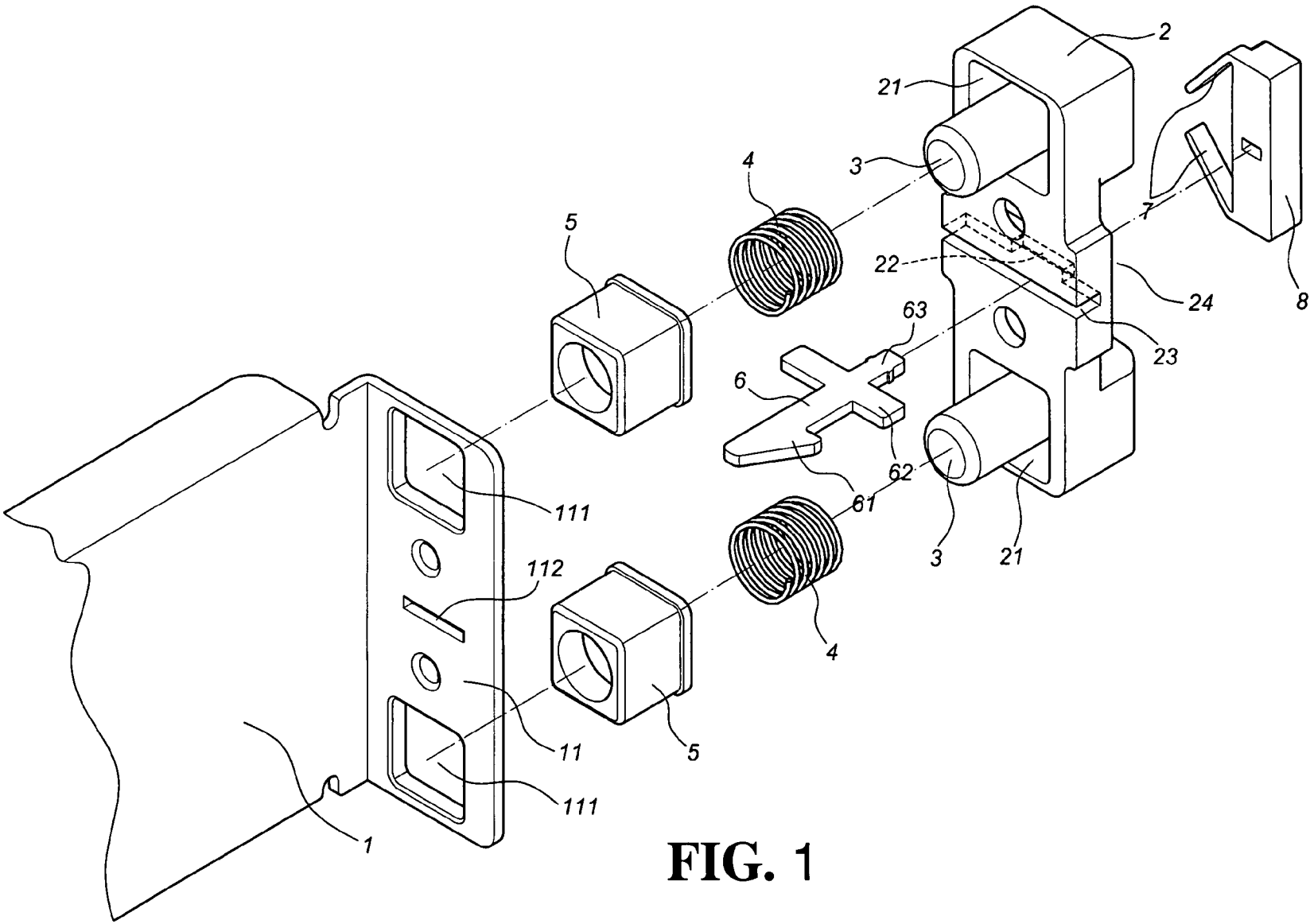
FIG. 1 is an exploded view of the present invention.
Figure 2:
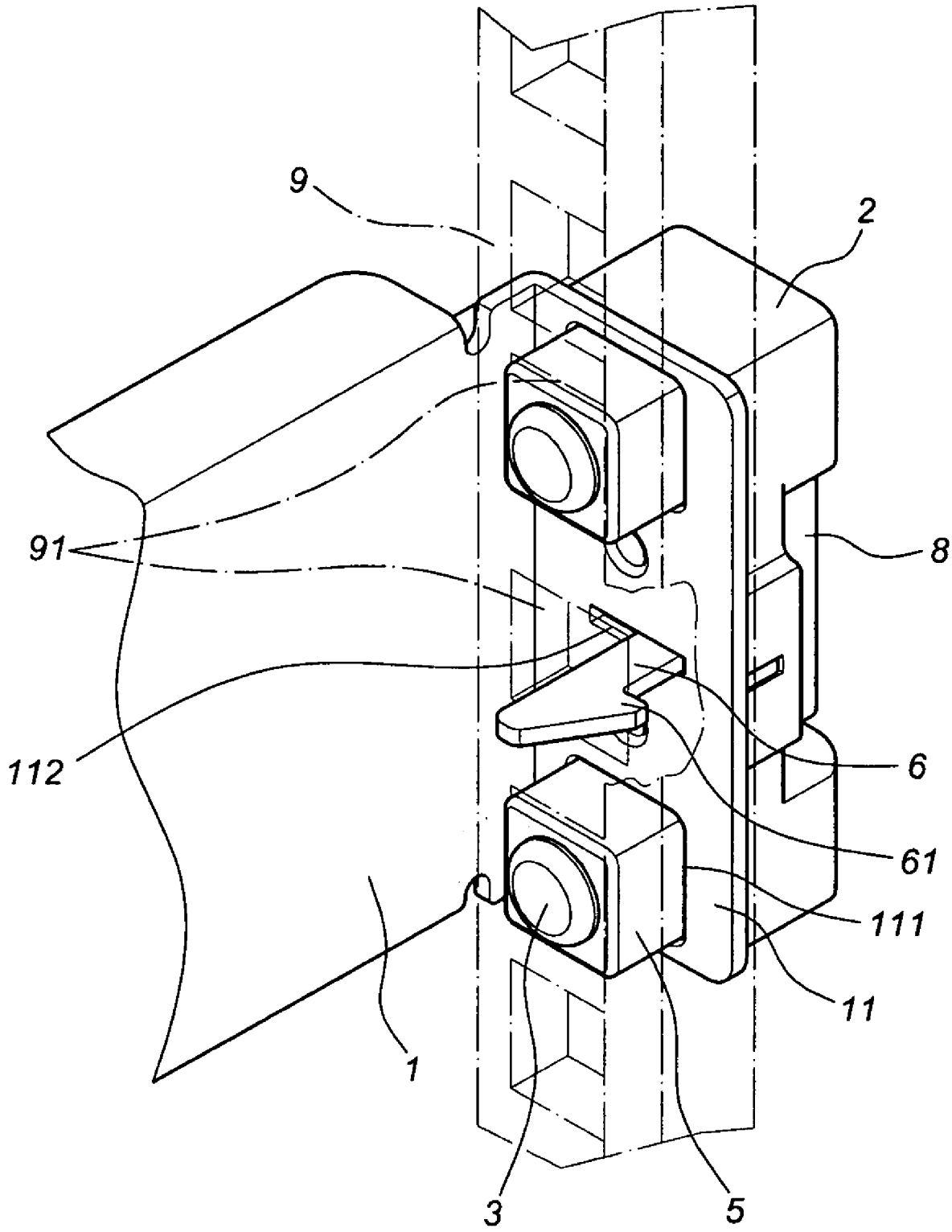
FIG. 2 is a perspective view of the present invention.

Referring to FIGS. 1 and 2, a preferred embodiment of the present invention comprises a body 1, a base 2, first hangers 3, first resilient elements 4, second hangers 5, a hook 6, a second resilient element 7 and a knob 8, and is fixed to a rack 9.

The body 1 comprises a fixing board 11 which is provided with openings 111 and a first longitudinal trough 112;

The base 2 comprises lodging spaces 21, a second longitudinal trough 22, a chute 23 and a flute 24. The lodging spaces 21 correspond in position to the openings 111 of the fixing board 11. The second longitudinal trough 22 corresponds in position to the first longitudinal trough 112 of the fixing board 11.

Each of the first hangers 3 is connecting to the lodging space 21 of the base 2.

Each of the first resilient elements 4 is wearing on the first hanger 3.

Each of the second hangers 5 is wearing on the first hanger 3 and engaging with the first resilient element 4. The second hanger 5 is movable between the opening 111 and the lodging space 21.

The hook 6 comprises an angle 61, a stopper 62 and a connecting section 63, penetrating the first longitudinal trough 112, the chute 23 and the second longitudinal trough 22. The stopper 62 slips relatively to the chute 23.

The second resilient element 7 clamps the hook 6 to have the angle 61 move horizontally. In this embodiment, the second resilient element 7 is a resilient bar.

The knob 8 is located in the flute 24 of the base 2 and connected with the connecting section 63 of the hook 6. The knob 8 connects to the second resilient element 7.

The rack 9, in this embodiment, has mounting holes 91 in square shape.

Figure 3:
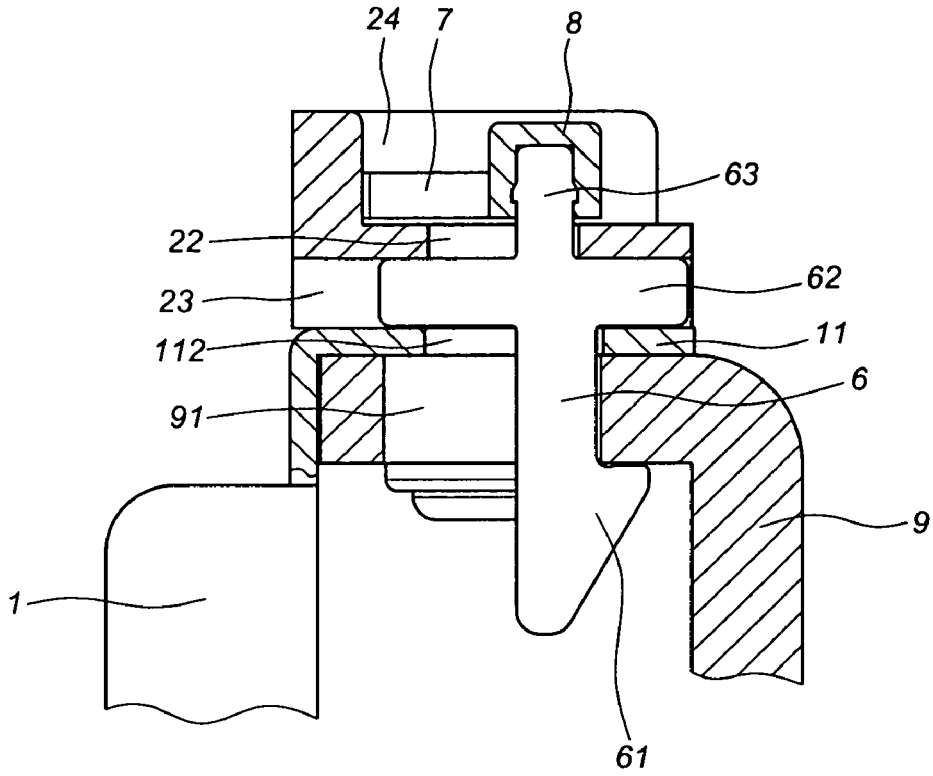
FIG. 3 is a cross-sectional view of the present invention.

During the assembly and the mounting to the rack 9, as shown in FIGS. 2 and 3, the body 1 is mounted to the rack 9, and the base 2 joins the fixing board 11 of the body 1. The first hanger 3 and the second hanger 5 are disposed on the fixing board 11 and the base 2. The first resilient element 4 is located between the first hanger 3 and the second hanger 5. The second hanger 5 is inserted in the mounting hole 91 of the rack 9. The hook 6 including the stopper 62 penetrates through the second longitudinal trough 22 and the chute 23. The connecting section 63 of the hook 6 is fixedly connected to the knob 8. The knob 8 and the second resilient element 7 are placed in the flute 24 of the base 2. The second resilient element 7 upholds the knob 8, which moves the hook 6 relatively to the rack 9, and makes the angle 61 buckled in the mounting hole 91 of the rack 9.

Figure 4:
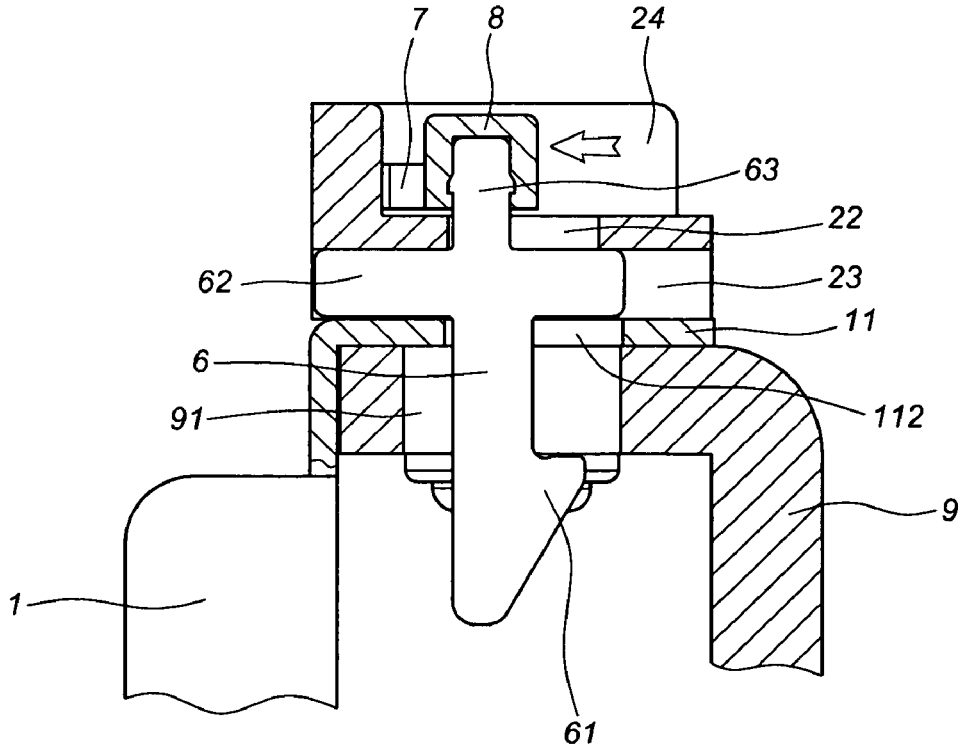
FIG. 4 is an operational schematic view of the present invention.

During the removal of the body 1, as shown in FIG. 4, when the knob 8 is pressed, the second resilient element 7 will in turn be pressed, which further drives the hook 6 to slip in the second longitudinal trough 22 and the chute 23. The angle 61 is also activated to escape from the mounting hole 91 of the rack 9, and the body 1 is then ready to be unloading from the rack 9.

Figure 5:
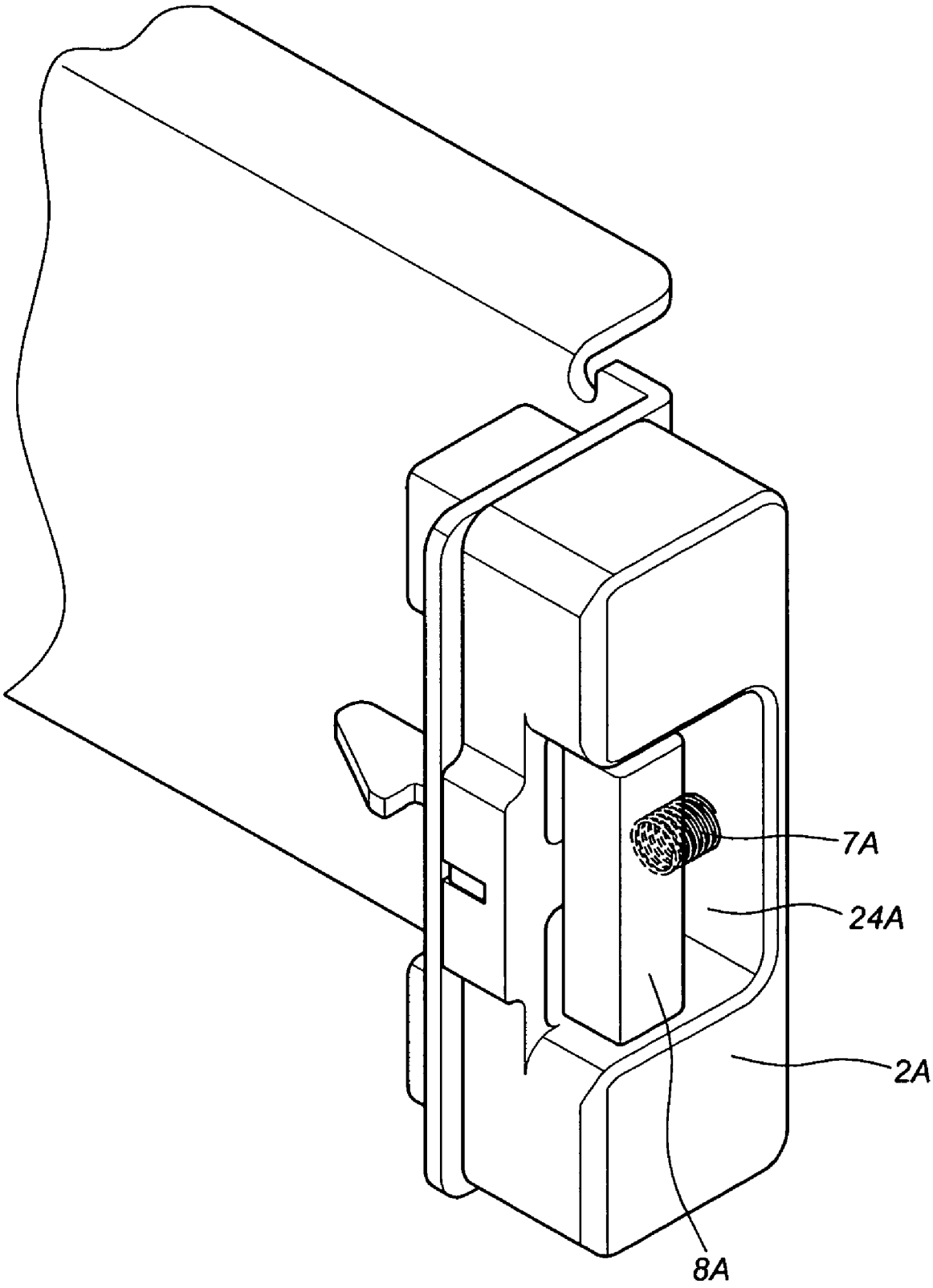
FIG. 5 is a perspective view of a second embodiment of the present invention.

FIG. 5 is a perspective view of a second embodiment of the present invention. A second resilient element 7A is a spring which is placed in a flute 24A of a base 2A and upholds a knob 8A.

Figure 6:
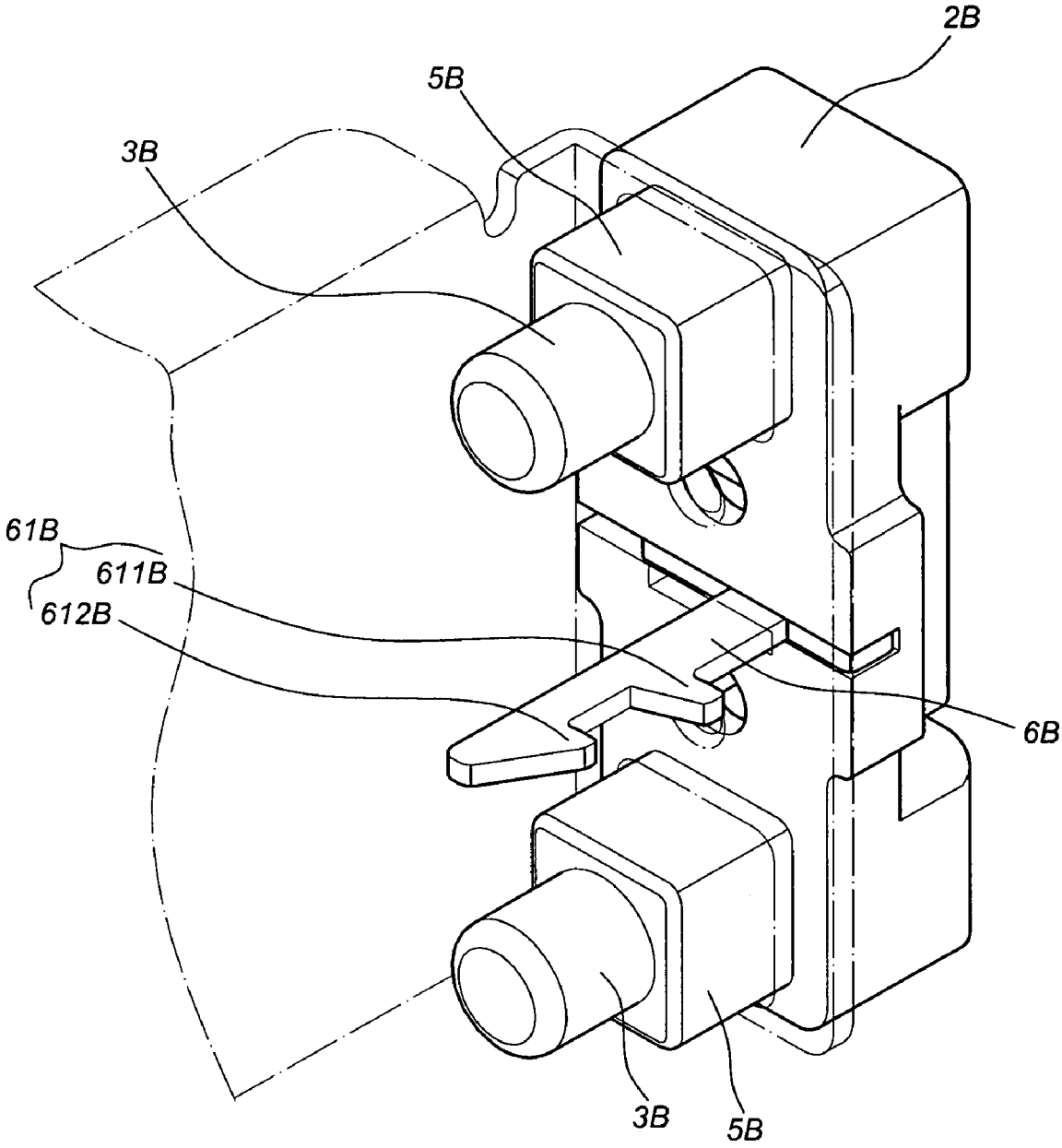
FIG. 6 is a perspective view of a third embodiment of the present invention.
Figure 7:
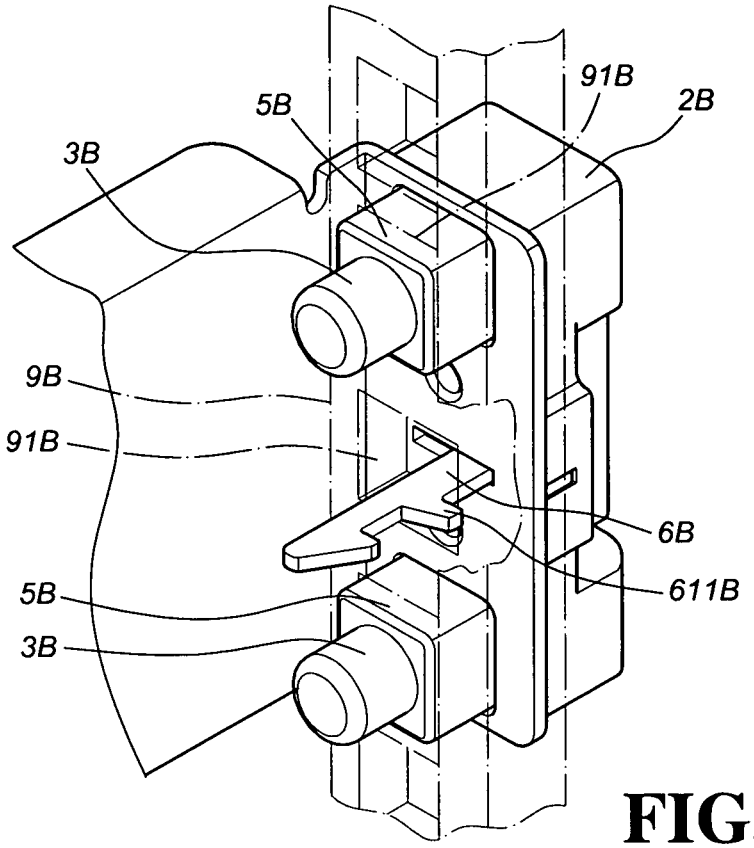
FIG. 7 is a schematic view showing a rack with mounting holes in square shape which is used by the third embodiment of the present invention.
Figure 8:
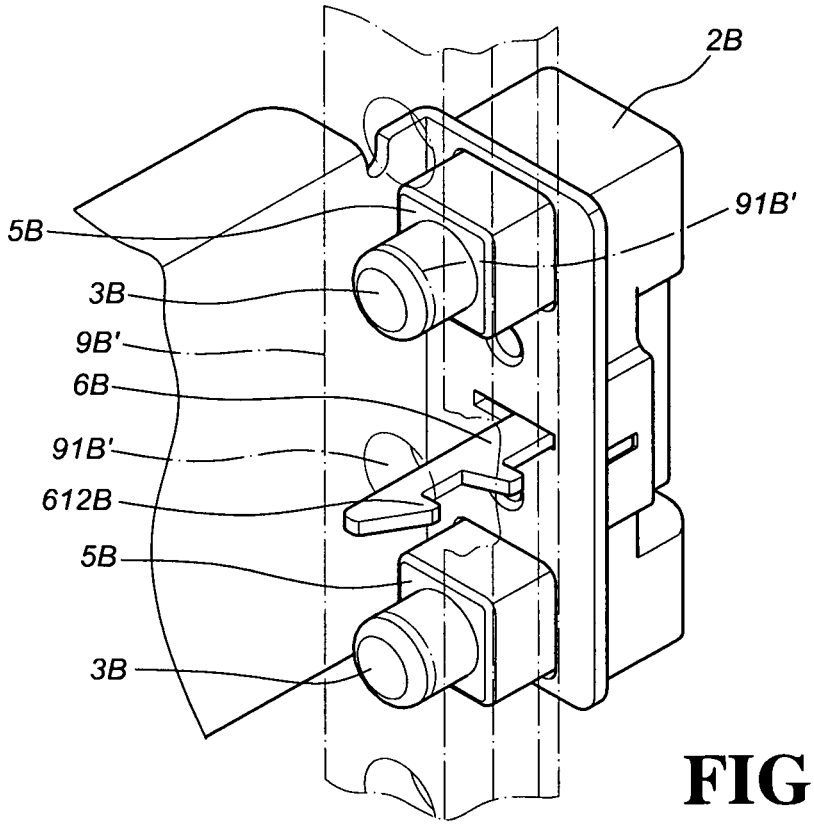
FIG. 8 is a schematic view showing a rack with mounting holes in circular shape which is used by the third embodiment of the present invention.

FIG. 6 is a perspective view of a third embodiment of the present invention. A first hanger 3B and a second hanger 5B are formed in a base 2B into an all-in-one shape which is a bi-segment cylinder. An angle 61B of a hook 6B comprises a first bend 611B and a second bend 612B. FIGS. 7 and 8 show the third embodiment that can be used in both a rack 9B with mounting holes 91B in square shape and a rack 9B' with mounting holes 91B' in circular shape.

What is claimed is:

1. A tool-less mounting slide bracket, comprising:

a body, comprising a fixing board, provided with openings and a first longitudinal trough thereon;

a base, comprising lodging spaces, a second longitudinal trough and a chute, wherein the lodging space corresponds to the opening of the fixing board, and the second longitudinal trough corresponds to the first longitudinal trough of the fixing board;

first hangers, each connecting to the lodging space of the base;

first resilient elements, each wearing on the first hanger;

second hangers, each wearing on the first hanger, clamping said first resilient element and being movable in the opening and the lodging space;

a hook, comprising an angle and a stopper, penetrating the first longitudinal trough, the chute and the second longitudinal trough, and the stopper slipping in the chute; and a second resilient element, corresponding to the hook and clamping the hook to drive the angle to move horizontally.

2. The tool-less mounting slide bracket as recited in claim 1, further comprising a knob, said hook further comprising a connecting section fixed to the knob.

3. The tool-less mounting slide bracket as recited in claim 2, wherein the knob is connected to the second resilient element and the second resilient element is a resilient bar.

4. The tool-less mounting slide bracket as recited in claim 1, wherein the base is provided with a flute.

5. The tool-less mounting slide bracket as recited in claim 4, wherein a knob and the second resilient element are provided in the flute of the base, the second resilient element being positioned against the knob, the second resilient element being a spring.

6. The tool-less mounting slide bracket as recited in claim 1, wherein the first hanger and the second hanger are formed in the base into an all-in-one shape which is a bi-segment cylinder.

7. The tool-less mounting slide bracket as recited in claim 1, wherein the angle of the hook comprises a first bend and a second bend.

* * * * *